US011753128B2

(12) United States Patent
Salihbegovic

(10) Patent No.: US 11,753,128 B2
(45) Date of Patent: Sep. 12, 2023

(54) OSD—OUTBOARD STERN DRIVE

(71) Applicant: Zlatko Salihbegovic, New Iberia, LA (US)

(72) Inventor: Zlatko Salihbegovic, New Iberia, LA (US)

(73) Assignee: Zlatko Salihbegovic, New Iberia, LA (US)

( * ) Notice: Subject to any disclaimer, the term of this patent is extended or adjusted under 35 U.S.C. 154(b) by 390 days.

(21) Appl. No.: 17/121,029

(22) Filed: Dec. 14, 2020

(65) Prior Publication Data

US 2021/0094664 A1 Apr. 1, 2021

(51) Int. Cl.
*B63H 20/22* (2006.01)
*B63H 20/10* (2006.01)

(52) U.S. Cl.
CPC ..... *B63H 20/22* (2013.01); *B63H 20/10* (2013.01)

(58) Field of Classification Search
CPC ..... B63H 20/10; B63H 20/22; B63H 20/28
See application file for complete search history.

(56) References Cited

U.S. PATENT DOCUMENTS 3,240,179 A * 3/1966 Van Ranst ..... F28D 1/022 165/44
4,239,013 A * 12/1980 Haynes ..... B63H 21/24 74/484 R
4,911,395 A * 3/1990 Jones, Jr. ..... B63H 20/36 248/351
2006/0189225 A1* 8/2006 Maselter ..... B63H 20/14 440/75
2006/0258233 A1* 11/2006 Wilson ..... B63H 3/00 440/53

* cited by examiner

*Primary Examiner* — Stephen P Avila

(57) ABSTRACT

An OSD-outboard stern drive boat propulsion system where single or multiple engines are positioned at boat stern inside boat outer envelope on customized-elevated subfloor and connected to outdrive unit that is attached to boat stern plate. Engine/s are positioned lower than typical outboard engine/s and higher than typical inboard engine/s. Engine compartment is covered by a customized hood and engines are easily accessible form boat floor like typical outboard engine configuration. Drive configuration is like typical sterndrive with engine/s crankshaft in horizontal position connected to outdrive via cardan joint allowing drive tilting up and down. The main purpose of using OSD would be use of one or two diesel or gasoline marine engines of existing design eliminating use of 2-6 large outboards for boats longer than 25 feet and outboard like access to engines for maintenance while using marine engines and providing much simpler boat/engine configuration.

12 Claims, 3 Drawing Sheets

OSD—OUTBOARD STERN DRIVE

CROSS-REFERENCE TO RELATED APPLICATIONS

None

STATEMENT REGARDING FEDERALLY SPONSORED RESEARCH OR DEVELOPMENT

Figure 1:
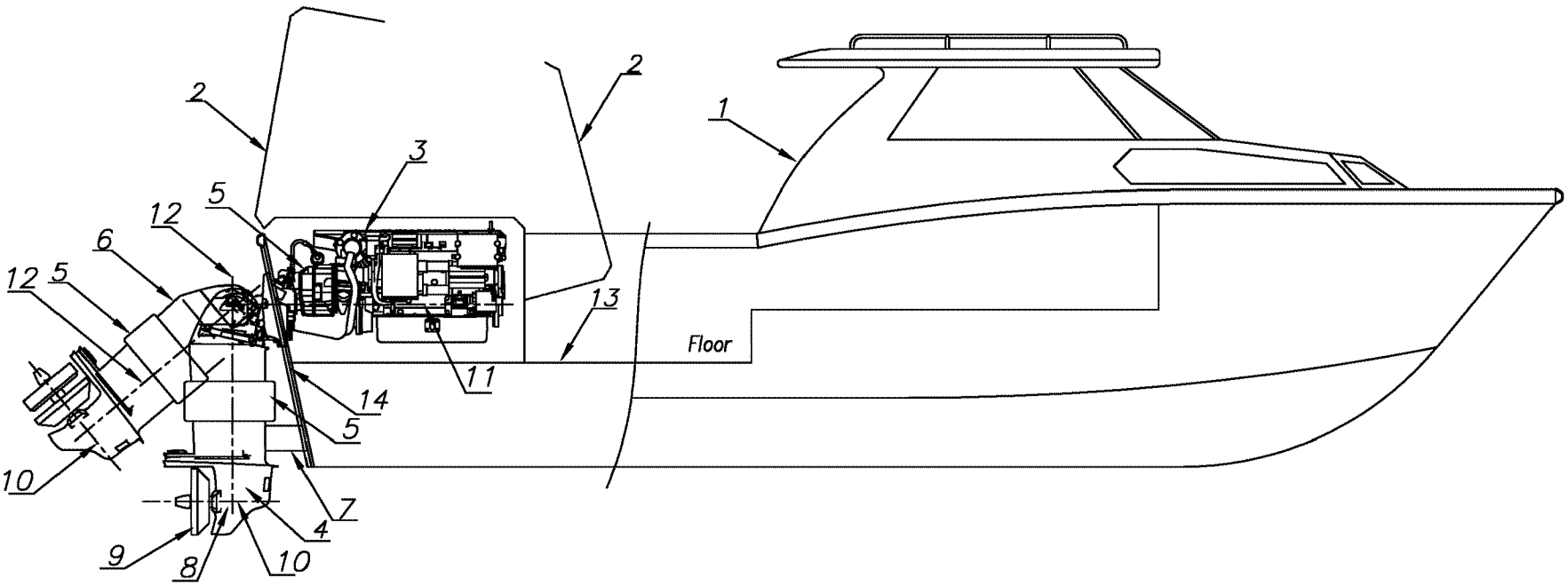

This patent development is not sponsored by federal research and development.

THE NAMES OF THE PARTIES TO A JOINT RESEARCH AGREEMENT

Not applicable, none

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Yes

STATEMENT REGARDING PRIOR DISCLOSURES BY THE INVENTOR OR A JOINT INVENTOR

There were no prior disclosures regarding this patent application.

BACKGROUND OF THE INVENTION

(1) Field of the Invention

Marine propulsion systems

(2) Description of Related Art Including Information Disclosed Under 37 CFR 1.97 and 1.98

None

BRIEF SUMMARY OF THE INVENTION

A boat propulsion system, OSD-Outboard Stern Drive where single, or multiple marine engines are positioned at boat stern inside boat outer envelope on customized-elevated subfloor and connected to outdrive unit that is attached to boat stern plate. Engine/s are positioned lower than typical outboard engine/s and higher than typical inboard engine/s. Engine compartment is covered by a customized hood and engines are easily accessible from boat floor like typical outboard engine configuration. Drive configuration is like typical sterndrive with engine/s crankshaft in horizontal position that is connected to outdrive unit via cardan joint allowing drive tilting up and down. The main purpose of using OSD would be use of one or two Diesel or gasoline marine engines of existing design thus eliminating use of 2-6 large outboards for boats longer than 25 feet and outboard like access to engines for maintenance while using sturdier marine engines and providing much simpler boat/engine configuration.

BRIEF DESCRIPTION OF THE SEVERAL VIEWS OF THE DRAWING(S)

FIG. 1: shows boat side cross section with OSD engine and outdrive.

Figure 2:
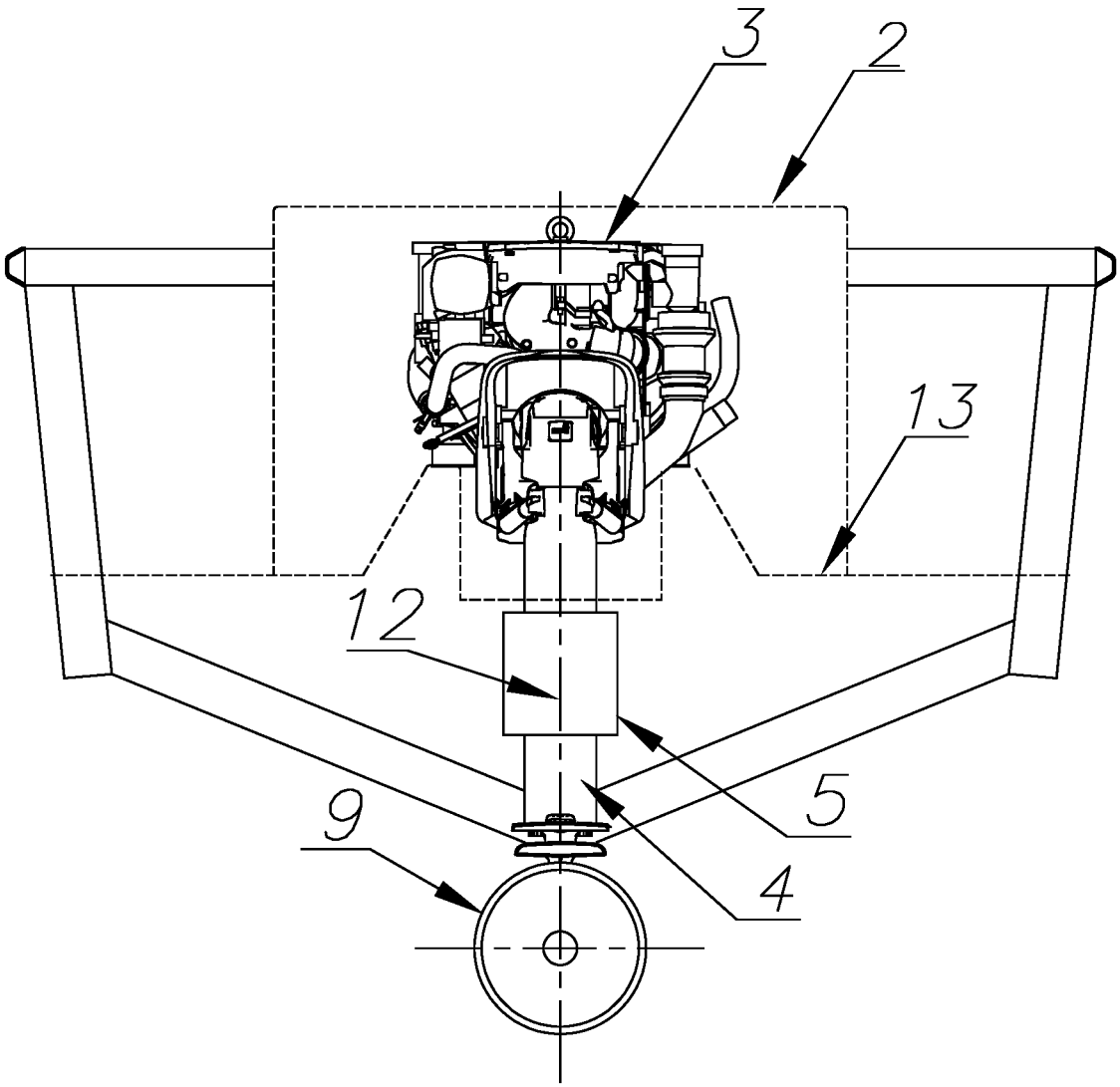

FIG. 2: shows rear view of OSD with single engine

Figure 3:
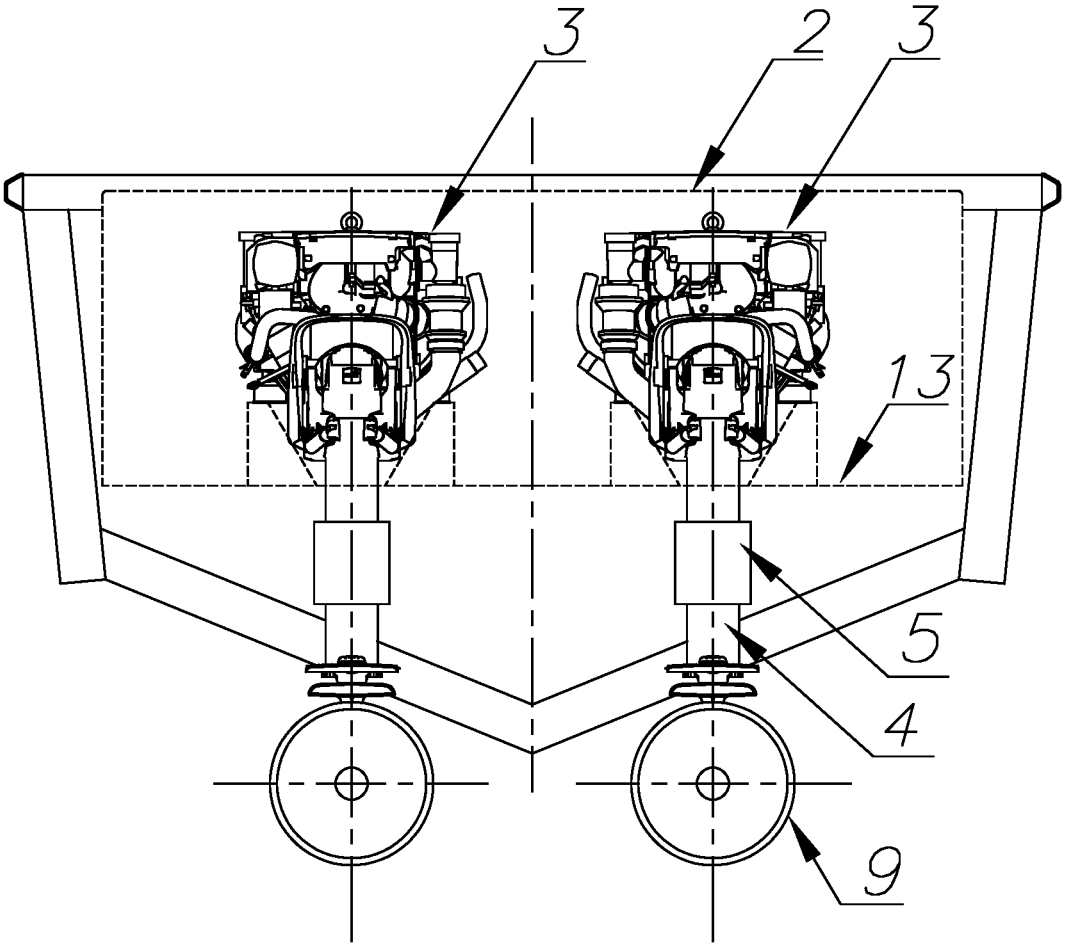

FIG. 3: shows rear view of OSD with dual engine configuration

DETAILED DESCRIPTION OF THE INVENTION

The presented invention, OSD-outboard stern drive combines advantages of OB-outboard and SD-stern drive power train configurations. OSD comprises of standard horizontally mounted marine engine 3 with crankshaft centerline 11 on customized boat subfloor 13 and outdrive unit 4 with vertical centerline 12, depicted in tilted and vertical position in FIG. 1 that is attached to boat stern plate 14 like standard SD. Said engine 3 is positioned higher than standard SD engine and lower than OB engine which improves boat vertical center of gravity. Since said engine 3 is positioned inside boat outer envelope it improves longitudinal center of gravity as well. Engine 3 is fully accessible from the outside of the floor when engine hood 2 is lifted or removed. Engine hood 2 can be lifted toward to the boat front or end or can be completely removed for easy access. Outdrive unit 4 is longer comparing to standard SD unit and shorter than OB engine unit and is fully accessible from outside. FIG. 1 shows boat cross section and layout of OSD. Marine engines are built sturdier with larger bearings, thicker wall sections, higher capacity of cooling system, and similar. Unlike car engines that use approximately 20% of available power for cruising marine engines are cruising at 80% of available engine power due to higher resistance of boat cruising.

OSD system have closed loop cooling system with sea water/antifreeze heat exchanger usually already supplied with the marine engine 3. Sea water inlet can be located in outdrive unit 4 or at the bottom or stern of the boat not in outdrive 4 for simplicity. Exhaust gases can be routed through outdrive 4 like on standard outboard engines or though hull like on standard inboard configuration for cost reduction and outdrive 4 simplification purposes.

OSD can have transmission 5 built into outdrive unit 4 or directly at the engine 3 flywheel end. Both options are shown on FIG. 1. Standard marine transmission as ZF or Twin Disc can be used. Transmission gear ratio can be adjusted for optimum RPM to accommodate use of existing propellers 9 available on the market. Using transmission and clutch in torpedo housing 8 is avoided because of need to accommodate extremely high torque and power generated by large Diesel engine and to reduce drag by minimizing torpedo housing 8 diameter. This reduction ratio would allow for torpedo housing 8 outer dimeter to be kept at minimum for lower drag. Lower conical gear set in torpedo housing 8 with centerline 10 should be so called double configuration to be able to withstand high Diesel engine torque. Outdrive 4 length can be standardized to several lengths like for OB engines and for single or dual engines configuration and to accommodate for boat size. Boat subfloor 13 height should be standardized accordingly to match outdrive 4 standardized lengths.

The above description of certain embodiment is made for the purposes of illustration only and are not intended to be limiting in any manner. Other alterations and modification of the preferred embodiment will become apparent to those of ordinary skill in the art upon reading this disclosure, and it is intended that the scope of the invention disclosed herein be limited only by the broadest interpretation of the appendix claims to which the invention is legally entitled.

OSD system generated pushing force is routed against boat stern plate 14 and controlled by hydraulic tilting of the outdrive 4 or through optional pusher block 7 located at lower position comparing to OD where pushing force position is located higher against stern plate 14. This would improve boat overall dynamics reducing yaw momentum. This description is sufficient for person skilled in related art.

The invention claimed is:

1. OSD-outboard stern drive system for boats comprising horizontally installed or multiple diesel or gasoline engines located inside a boat outer envelope and appropriate outdrive located at the stern of the boat and attached to it, wherein marine engine assembled into boat engine room on customized elevated subfloor equipped with sea water/antifreeze heat exchanger, marine gear box installed either at the engine flywheel side or into outdrive, the system better uses boat space since a cover is provided for the engine room, the cover can be used for fishing or as a sun deck which is not the case with OB engines where space occupied by engines is unusable, the system further using commercially readily available marine engines and transmission/clutch located at the engine end or in the outdrive but not in torpedo housing thus providing outdrive simplicity and better reliability, smaller torpedo housing diameter and less drag.

2. OSD-outboard stern drive system for boats of claim 1, further providing better vertical center of gravity compared to OB engines because engine/s are installed lower within the boat outer envelope.

3. OSD-outboard stern drive system for boats of claim 1, further providing better longitudinal center of gravity compared to OB engines because engine/s are installed within boat outer envelope.

4. OSD-outboard stern drive system for boats of claim 1, further providing ease access to engine room from every angle the same way as in OB and much better accessibility compared to I/O inboard outboard engine systems.

5. OSD-outboard stern drive system for boats of claim 1, further using standard readily available diesel or gasoline marine engines which in complete configuration with outdrive can be up to 50% cheaper compared to standard high power OB engines for the same power rating but in diesel configuration thus also providing 50% better fuel economy.

6. OSD-outboard stern drive system for boats of claim 1, further not needing more than two engines to match or exceed any of today's high power boats sometimes using up to 4-6 627 HP OB engines, to significantly reduce multi-engine configurations complexity, simplifying maintenance, setup process, fuel distribution system and propeller configuration.

7. OSD-outboard stern drive system for boats of claim 1, further providing better engine corrosion resistance using closed loop cooling system with antifreeze comparing to OB since most outboards are cooled by corrosive sea water.

8. OSD-outboard stern drive system for boats of claim 1, further having a sea water intake through outdrive or at the boat bottom simplifying outdrive design.

9. OSD-outboard stern drive system for boats of claim 1, further exhaust gases are evacuated through hull or through outdrive for better efficiency, smaller torpedo diameter, better reliability, improved simplicity, lower costs and less drag.

10. OSD-outboard stern drive system for boats of claim 1, further the outdrive tilts the same way as SD system which provides protection from collision with underwater obstacles.

11. OSD-outboard stern drive system for boats of claim 1, further being customized to use a surface piercing propulsion system.

12. OSD-outboard stern drive system for boats of claim 1, further being designed to provide pushing force against a pusher block positioned low on a stern plate for better boat performance.

* * * * *